US011371532B1

(12) United States Patent
Liu et al.

(10) Patent No.: US 11,371,532 B1
(45) Date of Patent: Jun. 28, 2022

(54) INLET COLLECTOR FOR CENTRIFUGAL FAN AND CENTRIFUGAL FAN

(71) Applicant: Xi'an Jiaotong University, Xi'an (CN)

(72) Inventors: Xiaomin Liu, Xi'an (CN); Chenye Tian, Xi'an (CN); Jiahao Wang, Xi'an (CN); Guang Xi, Xi'an (CN)

(73) Assignee: XI'AN JIAOTONG UNIVERSITY, Xi'an (CN)

( * ) Notice: Subject to any disclaimer, the term of this patent is extended or adjusted under 35 U.S.C. 154(b) by 0 days.

(21) Appl. No.: 17/577,876

(22) Filed: Jan. 18, 2022

(30) Foreign Application Priority Data

May 21, 2021 (CN) ..... 202110560483.0

(51) Int. Cl.
*F04D 29/44* (2006.01)
*F04D 29/42* (2006.01)
*F04D 17/08* (2006.01)

(52) U.S. Cl.
CPC ..... *F04D 29/4226* (2013.01); *F04D 17/08* (2013.01); *F04D 29/4213* (2013.01); *F04D 29/441* (2013.01); *F05D 2250/51* (2013.01)

(58) Field of Classification Search
CPC ..... F04D 29/4213; F04D 29/4226; F04D 29/441; F05D 2250/51
See application file for complete search history.

(56) References Cited

U.S. PATENT DOCUMENTS 2,290,423 A * 7/1942 Funk ..... F04D 29/4213 415/206
4,549,848 A * 10/1985 Wallman ..... F04D 29/4213 415/206
5,551,836 A * 9/1996 Roth ..... F04D 29/4213 415/206
7,883,312 B2 * 2/2011 Eguchi ..... F04D 29/665 415/206

* cited by examiner

*Primary Examiner* — Ninh H. Nguyen
(74) *Attorney, Agent, or Firm* — WPAT, PC

(57) ABSTRACT

An inlet collector for a centrifugal fan and a centrifugal fan are provided. By arranging a tragus-shaped section in a guiding section, reverse flow caused by intersection of inlet leakage flow at a volute tongue side and inlet airflow is blocked by the tragus-shaped structure in movement process, and the leakage flow no longer collide with the inlet airflow. An inner curved surface of the tragus-shaped section controls backflow to change smoothly along an inner wall surface of the tragus-shaped section and re-enter a volute for circulation. A tragus profile is adopted to guide the airflow to change more smoothly in the velocity direction near the wall of the guiding section, so as to effectively reduce the impact of the inlet airflow on the guiding section. By using the inlet collector, energy loss of airflow is reduced, vortex formation is suppressed, and aerodynamic performance and fan noise are improved.

8 Claims, 6 Drawing Sheets

INLET COLLECTOR FOR CENTRIFUGAL FAN AND CENTRIFUGAL FAN

TECHNICAL FIELD

The invention relates to the technical field of fans, and specifically to an inlet collector for a centrifugal fan and a centrifugal fan.

BACKGROUND

Centrifugal fans are widely used in household appliances, plant ventilation, etc. because of excellent performance. The core structure of centrifugal fans generally includes the volute, impeller, motor, inlet collector and so on. During the operation of the centrifugal fan, the airflow enters the fan through the collector and moves along the volute profile for diffusion. After the airflow is split by the volute tongue, a small part of the non-discharged airflow crosses and collides with the radial inflow in the blade channel near the volute tongue; part of the airflow after intersection and collision reversely flows out, forming a vortex blockage in the blade channel, and the other part of the airflow re-enters the volute for circulation along the volute tongue clearance. At the impeller inlet side, the blockage of the blade channel forces the inlet airflow near the volute tongue side not to enter the blade channel immediately, and meanwhile, part of the reverse leakage airflow cannot return to the impeller in time. Subsequently, affected by the impeller, these two airflows move along the rotating direction, and flow out reversely and then collide with the inlet airflow in the axial direction. The airflow collision reduces the inlet area of the centrifugal fan, causes energy loss and increases noise in the region near the inlet of the fan, which seriously affects the performance of the fan. How to optimize the structural design of fan, improve the aerodynamic performance of the fan and reduce the noise of the fan is of great significance to the development of the fan industry.

Traditional noise reduction method is mainly realized by reducing the rotation speed of the centrifugal fan or adding sound-absorbing materials to the structure of the centrifugal fan; the former way sacrifices the performance of the product, while the latter way increases the cost of the product, both of which are difficult to produce obvious effects in product design at present. The structural design of the collector used in the centrifugal fan adopted currently mainly includes the matching and optimization of the clearance and arc radius of the collector, aiming to reduce the influence of the vortex on the flow field in the collector clearance; in addition, elliptical collector design is also used to reduce the impact of airflow on collector surface and accelerate the airflow more smoothly. The above method has no obvious effects on suppressing the reverse cross between the leakage flow, caused by the blockage of the blade channel near the volute tongue, and the inlet airflow. Therefore, it is necessary to further improve the design of inlet side air duct based on collector structure.

SUMMARY

An objective of the invention is to provide an inlet collector for a centrifugal fan and a centrifugal fan to overcome the shortcomings of the prior art.

To achieve the above objective, the invention adopts the following technical solutions.

Specifically, in an aspect, an inlet collector for a centrifugal fan includes a connecting section, a guiding section and a tragus-shaped section. The guiding section is connected to an outer wall surface of a fan volute at a side close to a fan volute inlet through the connecting section, the guiding section has a conical structure, and a middle of the guiding section is disposed with a through-hole. The tragus-shaped section has an arc-shaped surface, and the tragus-shaped section is arranged on an inner side of the guiding section, and the tragus-shaped section is a structure formed of lofting of a tragus profile along an axis of an impeller of the centrifugal fan.

In an embodiment, a width central point of tragus is taken as an origin of a coordinate system, a x direction in the coordinate system indicates a width distribution of the tragus, and a y direction indicates a height distribution of tragus, and an equation of the tragus profile is:

$$y(x) = \begin{cases} -3.2x^2 - 2.464x - 0.432, & -0.5 \le x < -0.27 \\ 0.24887 - \frac{5}{12}(x + 0.2037) - \sqrt{\frac{0.33636}{4.2} - \frac{58.31}{70.56}(x + 0.2037)^2}, & -0.27 \le x < 0.07 \\ -2.4x^2 + 1.368x - 0.084, & 0.07 \le x \le 0.5 \end{cases}.$$

In an embodiment, the guiding section may include an arc-shaped guiding segment and a vertical guiding segment. A cross-section of the arc-shaped guiding segment along an axis of the conical structure is a ¼ circular surface. The vertical guiding segment is arranged extending along an axis of a turbine of the centrifugal fan, and the guiding section is coaxially arranged with the turbine in the centrifugal fan.

In an embodiment, an included angle between an arc midpoint line of the tragus-shaped section and a horizontal plane is $\alpha$, and a value range of $\alpha$ is 140°-160°.

In an embodiment, an arc angle of the tragus-shaped section is $\beta$, and a value range of $\beta$ is 50°-80°.

In another aspect, a centrifugal fan may include a fan volute, an inlet collector and an impeller. The impeller is fixed in the fan volute, and a side of the fan volute is disposed with a fan volute inlet, and the inlet collector is fixed at the fan volute inlet. The inlet collector may include a connecting section, a guiding section and a tragus-shaped section. The guiding section is connected to an outer wall surface of the fan volute at a side adjacent to the fan volute inlet through the connecting section, the guiding section has a conical structure, and a middle of the guiding section is disposed with a through-hole. The tragus-shaped section has an arc-shaped surface, the tragus-shaped section is arranged on an inner side of the guiding section, and the tragus-shaped section is formed of lofting of a tragus profile along an axis of the impeller of the centrifugal fan.

In an embodiment, the guiding section may include an arc-shaped guiding segment. The arc-shaped guiding segment extends radially from an inner side of the connecting section to the fan volute, with the connecting section as a starting section, a cross-section of the arc-shaped guiding segment along a direction of an extending depth being ¼ circular surface, and a through-hole structure being as an end point of extending.

In an embodiment, the guiding section may include a vertical guiding segment. The vertical guiding segment is arranged extending along an axial direction of a turbine of the centrifugal fan, and the guiding section is coaxially arranged with the turbine in the centrifugal fan.

In an embodiment, a width central point of tragus is taken as an origin of a coordinate system, a x direction of the coordinate system indicates a width distribution of tragus, and a y direction of the coordinate system indicates a height distribution of tragus, and an equation of the tragus profile is:

$$y(x)=\begin{cases}-3.2x^2-2.464x-0.432, & -0.5\le x<-0.27\\ 0.24887-\frac{5}{12}(x+0.2037)-\sqrt{\frac{0.33636}{4.2}-\frac{58.31}{70.56}(x+0.2037)^2}, & -0.27\le x<0.07\\ -2.4x^2+1.368x-0.084, & 0.07\le x\le 0.5\end{cases}.$$

Two end points of the tragus profile are located on an arc at a junction of the connecting section and the tragus-shaped section, a radius of the arc is R, and the y direction of the tragus profile is a radial inward extension direction of the tragus-shaped section.

In an embodiment, a distance from a maximum horizontal extension height of the tragus-shaped section to an axis center of the impeller is L, and a value range of L/R is 0.65-0.8. An included angle between a midpoint line of an outer arc of the tragus-shaped section and a horizontal plane is α, and a value range of α is 140°-160°. An arc angle of the outer arc of the tragus-shaped section is β, and a value range of β is 50°-80°.

Compared with the prior art, the invention has the following beneficial technical effects.

According to the invention, the tragus-shaped section is arranged in the guiding section of the inlet collector used in the centrifugal fan. The reverse flow, caused by the intersection of the leakage flow near the volute tongue and the inlet airflow, is impeded by the tragus-shaped structure during the movement of the airflow, and no longer collides with the inlet airflow, thus effectively controlling the vortex generation and kinetic energy loss; the inner curved surface of the tragus-shaped section controls the backflow to change smoothly along the inner wall surface of the tragus-shaped section and re-enter the volute for circulation; the tragus profile is adopted to guide the airflow to change more smoothly in the velocity direction near the wall of the guiding section, so as to effectively reduce the impact of the inlet airflow on the guiding section; and the inner curved surface of the tragus-shaped section is designed to avoid the collision between the airflow and the collector, which may cause the dispersion of the airflow, then reduce the impact noise and the vortex noise of the centrifugal fan.

The control of the airflow collision and the smooth transition of the inlet airflow, caused by the tragus-shaped section, compensate the flow loss of the centrifugal fan which is due to the reduction of the inlet area, thus improving the aerodynamic performance of the centrifugal fan and reducing the fan noise.

The centrifugal fan according the invention reduces the energy loss of airflow, suppresses the vortex generation, and improves the aerodynamic performance of the centrifugal fan and fan noise by reducing the collision between the inlet backflow near the volute tongue and the inlet airflow, changing the inlet airflow direction smoothly, and dispersing the impact of the inlet airflow and backflow on the collector.

DETAILED DESCRIPTION OF EMBODIMENTS

The invention will be described in further detail below with reference to the accompanying drawings.

The invention will be described in further detail below with specific embodiments, which are meant to explain the invention rather than limit it.

As shown in FIG. 1, FIG. 4 to FIG. 6, an inlet collector for a centrifugal fan includes a connecting section 21, a guiding section and a tragus-shaped section 24. The guiding section is connected to an outer wall surface of a fan volute at a side close to the fan volute inlet through the connecting section 21. The guiding section has a conical structure, and a middle of the guiding section is disposed with a through-hole. The tragus-shaped section 24 has an arc-shaped surface, the tragus-shaped section 24 is arranged on an inner side of the guiding section, and the tragus-shaped section 24 is formed of lofting of a tragus profile along an axis of an impeller of the centrifugal fan.

A width central point of tragus is taken as an origin of a coordinate system, a x direction of the coordinate system indicates a width distribution of tragus, and a y direction of the coordinate system indicates a height distribution of tragus, and an equation of the tragus profile is:

$$y(x)=\begin{cases}-3.2x^2-2.464x-0.432, & -0.5\le x<-0.27\\ 0.24887-\frac{5}{12}(x+0.2037)-\sqrt{\frac{0.33636}{4.2}-\frac{58.31}{70.56}(x+0.2037)^2}, & -0.27\le x<0.07\\ -2.4x^2+1.368x-0.084, & 0.07\le x\le 0.5\end{cases}.$$

The guiding section extends radially from an inner side of the connecting section 21 into the fan volute, forming a conical structure with a middle through-hole.

Figure 4:
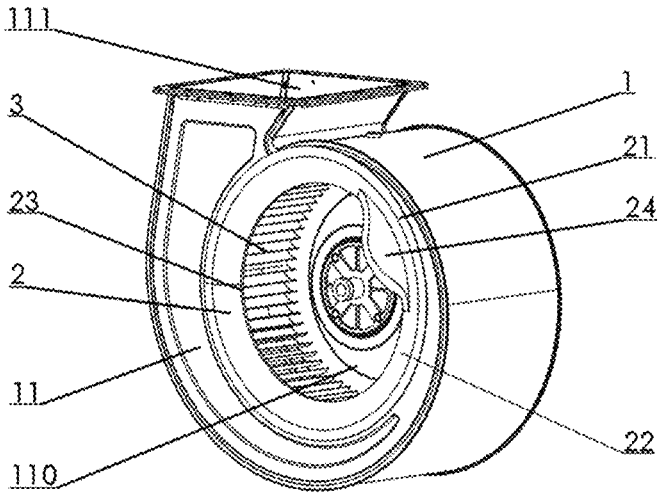
FIG. 4 is a schematic structural diagram of a centrifugal fan according to an embodiment of the invention.

As shown in FIG. 4, the guiding section includes an arc-shaped guiding segment 22 and a vertical guiding segment 23. A cross-section of the arc-shaped guiding segment 22 along an axis of the conical structure is a ¼ circular surface, that is, the arc-shaped guiding segment 22 extends radially from the inner side of the connecting section 21 into the fan volute, with the connecting section 21 as a starting section, the cross-section of the arc-shaped guiding segment 22 along a direction of an extending depth is ¼ circular surface, and a through-hole structure being as an end point of extending, forming the conical structure. The vertical guiding segment 23 is arranged extending along an axis of a turbine of the centrifugal fan, and the guiding section is coaxially arranged with the turbine in the centrifugal fan.

Figure 5:
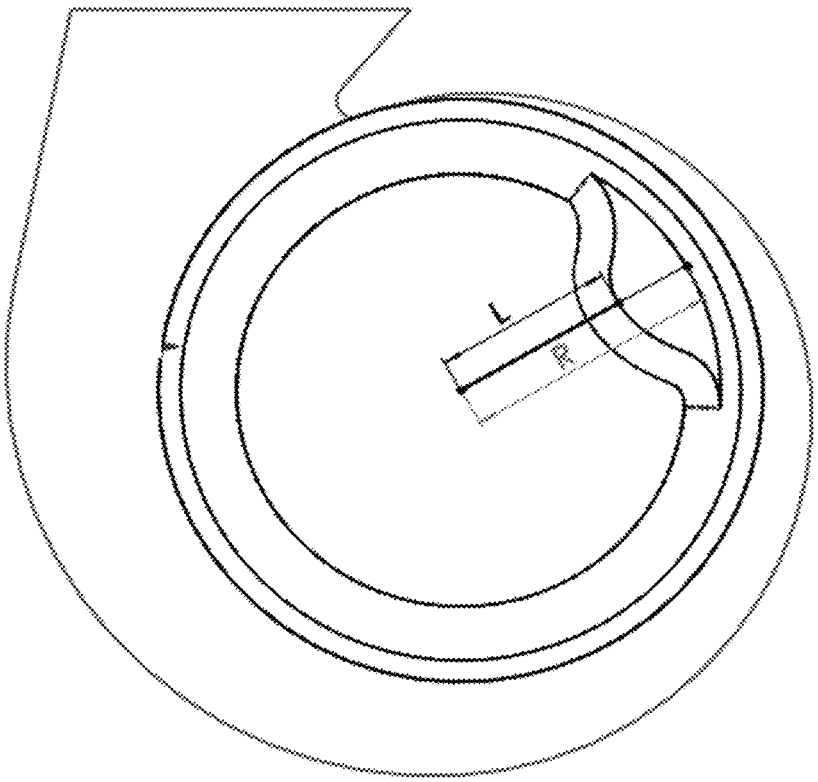
FIG. 5 is a schematic structural diagram from a front perspective view of the inlet collector according to the embodiment of the invention.
Figure 6:
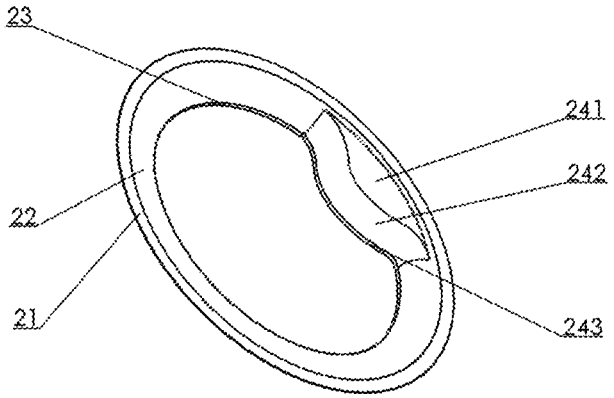
FIG. 6 is a schematic diagram of a three-dimensional structure of the inlet collector according to the embodiment of the invention.

As shown in FIG. 5, the tragus-shaped section 24 is fixed on part of the guiding section 21, specifically on the arc-shaped guiding segment 22. An included angle between an arc midpoint line of the tragus-shaped section 24 and a horizontal plane is α, and a value range of α is 140°-160°. An arc angle of the tragus-shaped section is β, and a value range of β is 50°-80°. The tragus-shaped section 24 extends radially inward and horizontally from a junction of the guiding section and the connecting section 21, and a profile of the extending end point is the tragus profile. The horizontal extending end point of the tragus-shaped section 24 extends radially inward into the fan volute, and the cross-section of the tragus-shaped section 24 is the same as that of the guiding section. The inner side of the tragus-shaped section of the fan volute is a three-dimensional smooth curved surface, which is formed according to the lofting of the tragus profile.

As shown in FIG. 4, in an illustrated embodiment, a centrifugal fan includes a volute 1, an inlet collector 2 and an impeller 3. The inlet collector 2 includes a connecting section 21, an arc-shaped guiding segment 22, a vertical guiding segment 23 and a tragus-shaped section 24. The inlet collector 2 is installed at the volute inlet 110, and the connecting section 21 is fixedly connected to a front cover plate of the volute 11, and a joint is sealed. The arc-shaped guiding segment 22 extends radially inward from the connecting section 21, with a cross-section of the arc-shaped guiding segment 22 being ¼ circular surface, and the vertical guiding segment 23 extends axially into the fan volute 1 from an end of a through-hole of the arc-shaped guiding segment 22. An included angle between a midpoint line of an outer arc of the tragus-shaped section 24 and a horizontal plane is α, and a value range of α is 140°-160°. An arc angle of the outer arc is β, and a value range of β is 50°-80°. A radius of the outer arc of the tragus-shaped section 24 is the same as that of the inner arc of the connecting section 21, and the tragus-shaped section 24 extends radially inward and horizontally from the junction, and the profile of the extending end point is the tragus profile. The centrifugal fan equipped with the inlet collector reduces the energy loss of airflow, suppresses the vortex formation, and improves the aerodynamic performance and fan noise by reducing the collision between the inlet backflow near the volute tongue and the inlet airflow, changing the inlet airflow direction smoothly, and dispersing the impact of the inlet airflow and backflow on the collector.

Figure 1:
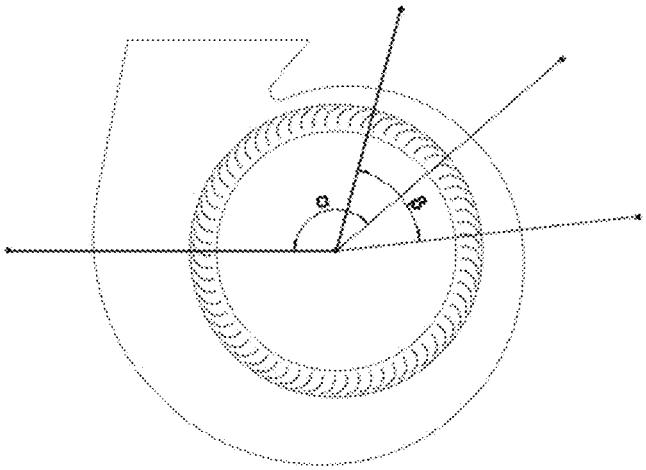
FIG. 1 is a schematic structural diagram of an installation of an inlet collector according to an embodiment of the invention.
Figure 2:
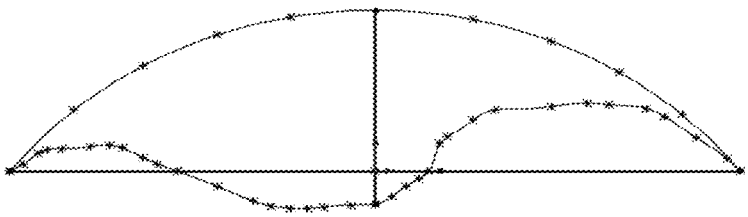
FIG. 2 is a schematic diagram of a tragus profile according to an embodiment of the invention.
Figure 3:
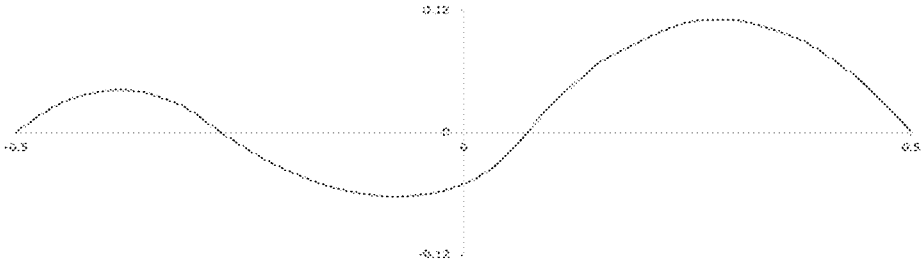
FIG. 3 is a schematic outline view of the tragus profile according to the embodiment of the invention.

The tragus-shaped structure and the multi-curved surface structure of the inner wall surface are adopted in the invention. By using the invention, the collision of the backflow and the inlet airflow is suppressed and the change of the airflow direction is more smoothly, while the vortex in the flow field and the impact of the airflow on the collector is reduced. By extracting the tragus-shaped contour data, the tragus profile is fitted by equation. As shown in FIG. 2 and FIG. 3, the central point of the tragus width is taken as the origin of the coordinate system, the x direction of the coordinate system indicates the tragus width distribution, and the y direction of the coordinate system indicates the tragus height distribution, and the equation of the tragus profile is:

$$y(x) = \begin{cases} -3.2x^2 - 2.464x - 0.432, & -0.5 \le x < -0.27 \\ 0.24887 - \frac{5}{12}(x + 0.2037) - \sqrt{\frac{0.33636}{4.2} - \frac{58.31}{70.56}(x + 0.2037)^2}, & -0.27 \le x < 0.07 \\ -2.4x^2 + 1.368x - 0.084, & 0.07 \le x \le 0.5 \end{cases}.$$

The two end points of the tragus profile are located on the circular arc at the junction of the connecting section 21 and the tragus-shaped section 24, the arc radius is R, and the y direction of the tragus profile is the radial inward extension direction of the tragus-shaped section 24. The distance from the maximum horizontal extension height of the tragus-shaped section 24 to the axial center of the impeller 3 is L, and the value range of L/R is 0.65-0.8.

The external airflow enters the volute 1 from the volute inlet 110 through the inlet collector 2; in this process, the airflow enters the impeller 3 evenly and smoothly under the guidance of the arc-shaped guiding segment 22 of the collector and a tragus-like arc extension section 242; with the rotation of impeller 3, the airflow changes from axial motion to radial motion and then enters the impeller blade channel. Affected by the impeller 3, the airflow rotates for diffusion along the volute 1; most of the airflow flows out of the volute outlet 111, while a small part of the airflow forms a blockage in the blade channel near the volute tongue, affected by the volute tongue. So the leakage flow and the inlet airflow in this region can't move through the blade channel in time along the rotating direction of the impeller 3. Due to the effect of the tragus-shaped section 24, this part of airflow is blocked in the axial outward flow direction and won't collide with the inlet airflow to form a vortex; under the guidance of the inner curved surface of the tragus-shaped section 24, the flow direction of this part of airflow changes smoothly; after flowing through the area of the tragus-shaped section 24, this part of airflow re-enters the blade channel of the impeller 3. This process effectively suppresses the vortex generated by the collision between the backflow and the inlet airflow, reduces the impact of the airflow on the collector, improves the aerodynamic performance of the fan, and reduces the impact noise and vortex noise of the fan.

A multi-blade centrifugal fan is selected as the control fan, and structural parameters of the fan are shown in Table 1. According to the structure of the control fan, an embodiment with the inlet collector is set to establish a control group. In this embodiment, the angle α at the midpoint of the outer arc of the tragus-shaped section is 150°, the outer arc range β of the tragus-shaped section is 65°, and the maximum horizontal extension height L of the tragus-shaped section is 0.8 R. The control fan and the embodiment are identical except for the collector.

Figure 7:
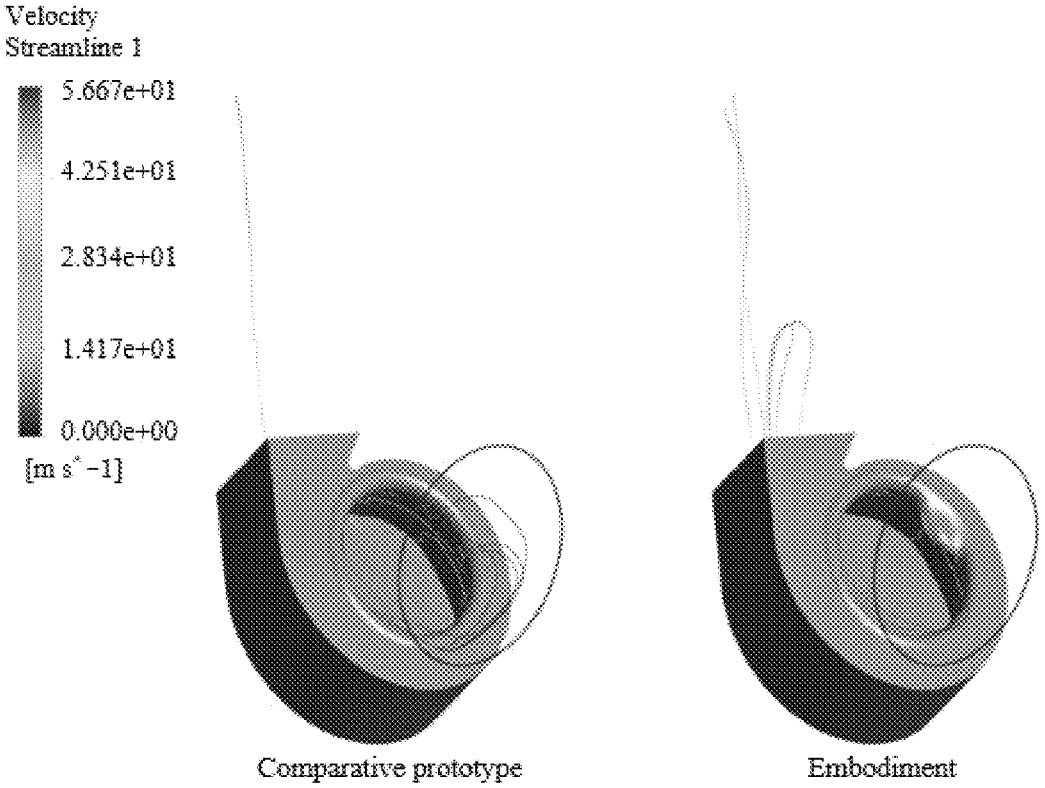
FIG. 7 is a schematic structural diagram of a comparison of streamlines at inlet sides between a control fan and a centrifugal fan adopting the inlet collector according to the embodiment of the invention.

Based on the software Solidwork, a three-dimensional fluid domain model is established. According to the air duct system of the centrifugal fan, the fluid domain is divided into four parts: inlet domain, impeller domain, volute domain and outlet domain, as shown in FIG. 7. The inlet extends upstream by 1.5 times the outer diameter of the impeller and the outlet extends downstream by 2 times the outer diameter of the impeller. Unstructured grids are divided in the computational domain, and the independence of grids is verified, so as to ensure that the numerical computation is accurate and reliable. Finally, the number of grids in impeller domain is 2.32 million, and the total number of grids is 4.87 million.

TABLE 1

Structural parameters of the control fan

| | | | |
|---|---|---|---|
| Impeller inner diameter/mm | 220 | Volute width/mm | 164 |
| Impeller outer diameter/mm | 252 | Collector height/mm | 18 |
| Impeller height/mm | 135 | Inlet diameter of collector/mm | 212.5 |
| Impeller section ratio | 4:3 | Outlet diameter of collector/mm | 210 |

Computational fluid dynamics (CFD) software Fluent 20.0 is used for numerical computation of the internal flow field of the fan, and the governing equation is Navier-Stokes equation; Realizable k-e model is used for the turbulent flow calculation, the near-wall treatment adopts standard wall function, SIMPLE algorithm is used for the pressure-velocity coupling, and the pressure discrete scheme adopts PRESTO! mode; the momentum equation, energy equation and turbulent dissipation equation all adopt the second-order upwind scheme, and the computational convergence residual is set to $10^{-4}$. Both the inlet and outlet are given pressure boundary conditions, the total inlet pressure is 0 and the outlet static pressure is 0. The inlet domain, volute domain and outlet domain are set as static domain, and the impeller domain is set as rotating domain, and Frame Motion model is adopted to set the rotational speed of the rotating area at 1100 revolutions per minute (rpm). Adjust the fan flow by controlling the outlet static pressure, and obtain the performance curve.

Figure 8:
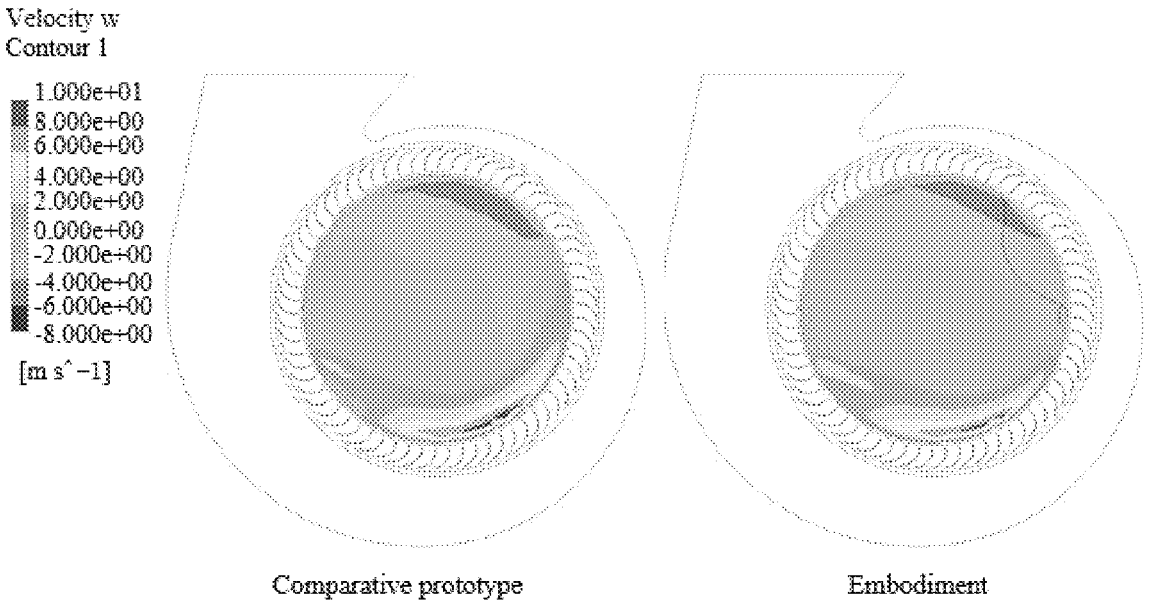
FIG. 8 is a schematic diagram of a comparison of speed components in the inlet direction between the control fan and the centrifugal fan adopting the inlet collector according to the embodiment of the invention.
Figure 9:
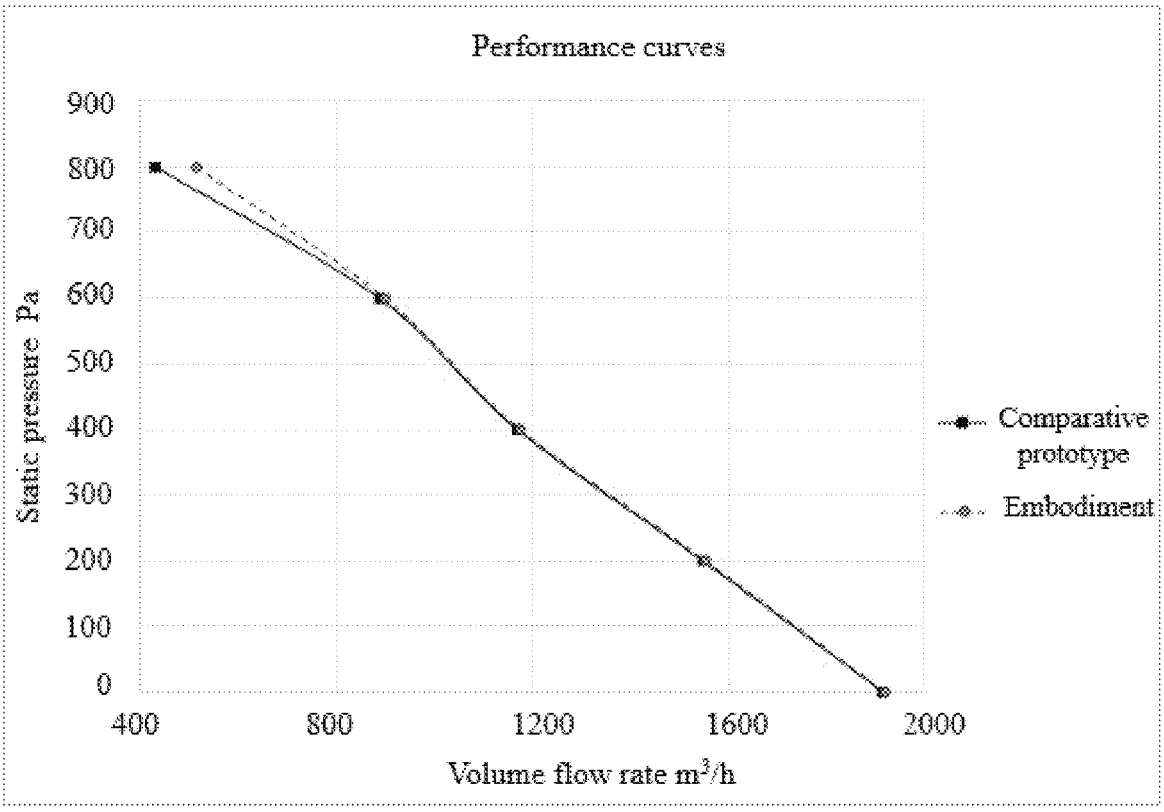
FIG. 9 is a schematic diagram of a comparison of performance curves between the control fan and the centrifugal fan adopting the inlet collector according to the embodiment of the invention.

The inlet side streamline state of the inlet collectors of the control fan and the embodiment of the invention at the same rotational speed and the same outlet static pressure is shown in FIG. 8. It can be seen from FIG. 8, the backflow on the inlet side of the control fan is more obviously, compared to the embodiment; the backflow flows out of the collector reversely from around 130°, collides with the inlet airflow, and then re-enters the volute area near the 270° position. However, after the embodiment adopts the tragus type inlet collector, there is basically no backflow in the same area, so the problems of flow loss and vortex noise caused by the collision between backflow and inlet airflow are effectively solved. FIG. 9 shows the component distribution of the actual air velocity on the inlet surface of the airflow at the volute inlet along the vertical direction, in which the negative direction represents inflow into the volute and the positive direction represents outflow from the volute. From the figure, it can be seen that after the tragus-like collector is adopted, the area of the bottom backflow area is reduced, and the inflow velocity near the tragus-shaped structure is increased, so the inlet state of the volute is effectively improved.

Figure 10:
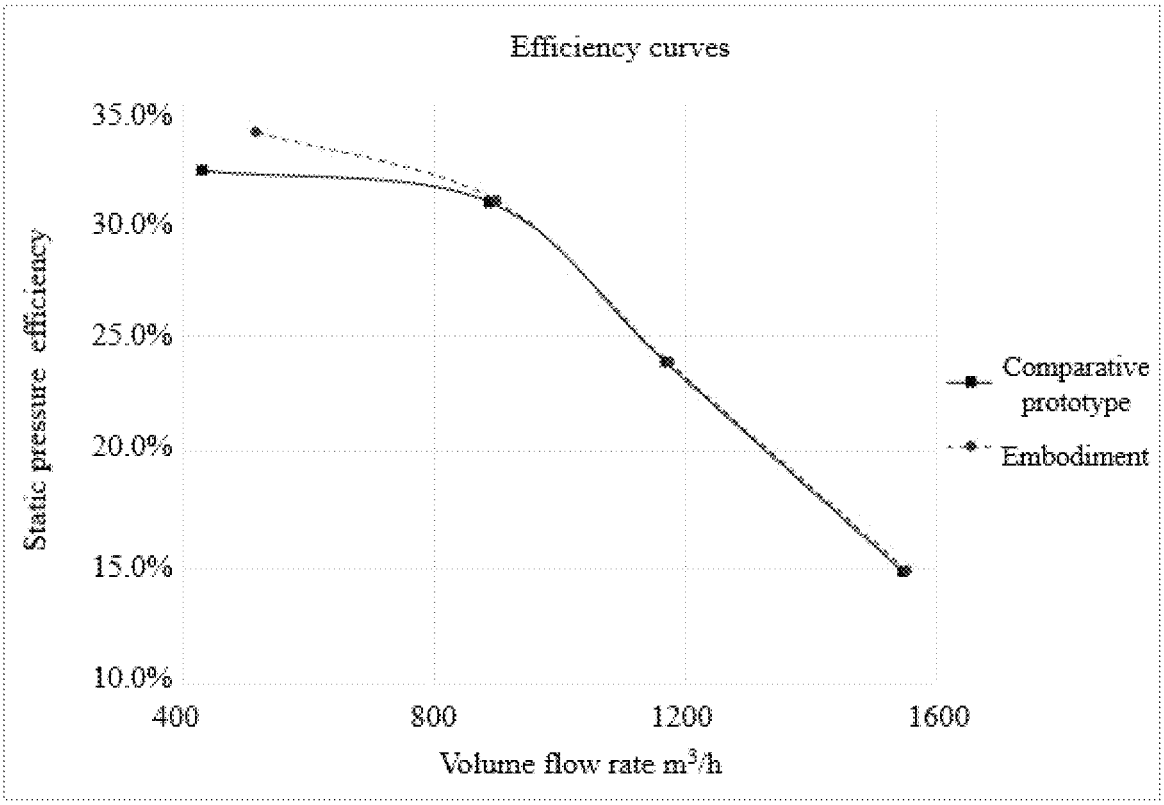
FIG. 10 is a schematic diagram of a comparison of efficiency curves between the control fan and the centrifugal fan adopting the inlet collector according to the embodiment of the invention.
Figure 11:
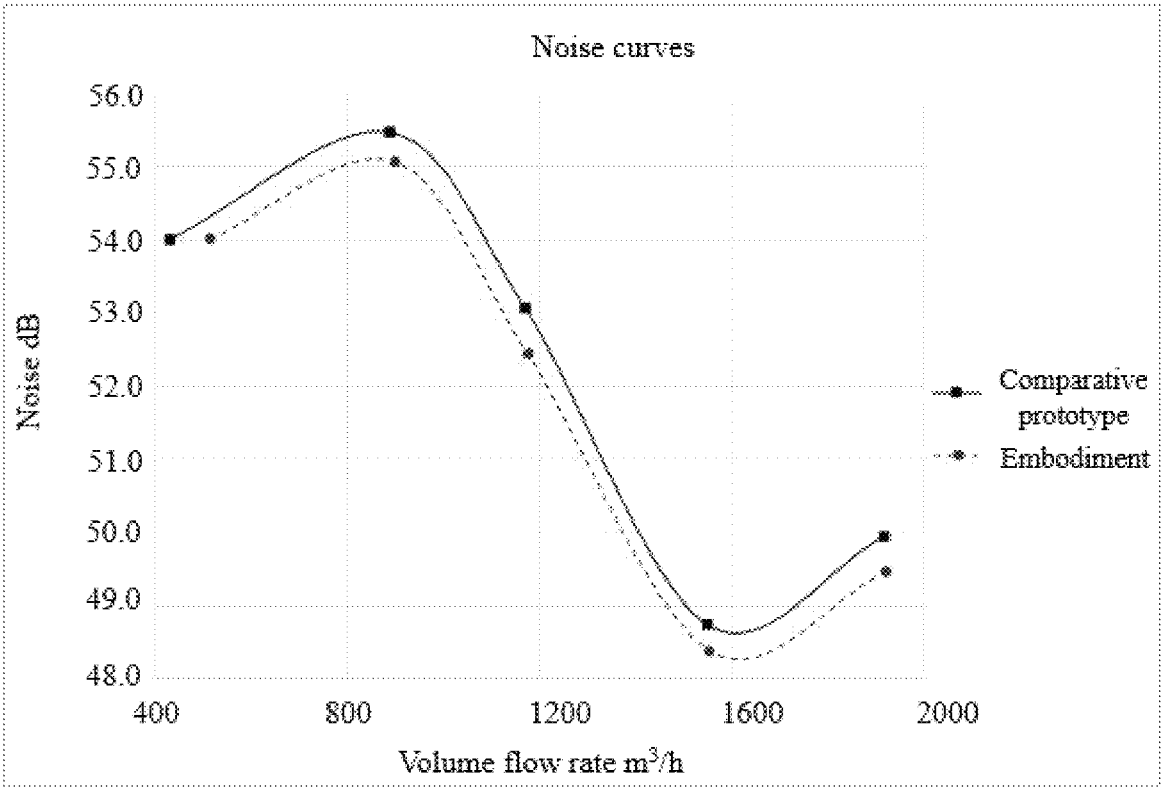
FIG. 11 is a schematic diagram of a comparison of noise curves between the control fan and the centrifugal fan adopting the inlet collector according to the embodiment of the invention.

The comparison results of volume flow rate and noise parameters under different static pressures of the comparison group are shown in Table 2, and see the comparisons of performance curves are respectively shown in FIG. 9-FIG. 11.

TABLE 2

Comparison results of volume flow rate and noise between control fan and embodiment of the invention

| | | Static pressure Pa | | | | |
|---|---|---|---|---|---|---|
| | | 0 | 200 | 400 | 600 | 800 |
| Control fan | Volume flow rate $m^3/h$ | 1916 | 1548 | 1170 | 888 | 430 |
| | Noise dB | 50.0 | 48.8 | 53.1 | 55.5 | 54.0 |
| Embodiment | Volume flow rate $m^3/h$ | 1919 | 1553 | 1175 | 899 | 515 |
| | Noise dB | 49.5 | 48.4 | 52.4 | 55.1 | 54.0 |

Under the same rotational speed and static pressure, the volume flow rate of the embodiment is higher than that of the control fan, and the gap gradually increases with the increase of static pressure. The volume flow rate of the centrifugal fan increases by 85 $m^3/h$ while the static pressure is 800 Pa. Under high static pressure, the static pressure efficiency of the embodiment is obviously higher than that of the control fan. In the case of any volume flow rate of the centrifugal fan, the volute noise of the embodiment is lower than that of the control fan. Therefore, compared with the current modification measures of the collector for collector clearance, arc radius, arc shape, etc., the fan according to the invention adopts the design of the tragus type inlet collector to effectively restrain the vortex generated by the collision between backflow and inlet airflow, and reduce the impact of airflow on the collector, improve the aerodynamic performance of the fan and reduce the impact noise and vortex noise of the fan.

What is claimed is:

1. An inlet collector for a centrifugal fan, comprising:

a connecting section, a guiding section and a tragus-shaped section;

wherein the guiding section is connected to an outer wall surface of a fan volute at a side close to a fan volute inlet through the connecting section, the guiding section comprises a conical structure, and a middle of the guiding section is disposed with a through-hole;

wherein the tragus-shaped section comprises an arc-shaped surface, and the tragus-shaped section is arranged on an inner side of the guiding section, and the tragus-shaped section is a structure formed of lofting of a tragus profile along an axis of an impeller of the centrifugal fan;

wherein a width central point of tragus is taken as an origin of a coordinate system, a x direction in the coordinate system indicates a width distribution of tragus, and a y direction in the coordinate system indicates a height distribution of tragus, and an equation of the tragus profile is:

$$y(x)=\begin{cases}-3.2x^2-2.464x-0.432, & -0.5\le x<-0.27\\ 0.24887-\frac{5}{12}(x+0.2037)-\sqrt{\frac{0.33636}{4.2}-\frac{58.31}{70.56}(x+0.2037)^2}, & -0.27\le x<0.07\\ -2.4x^2+1.368x-0.084, & 0.07\le x\le 0.5\end{cases}.$$

2. The inlet collector according to claim 1, wherein the guiding section comprises: an arc-shaped guiding segment and a vertical guiding segment;

wherein a cross-section of the arc-shaped guiding segment along an axis of the conical structure is a ¼ circular surface;

wherein the vertical guiding segment is arranged extending along the axis of the impeller of the centrifugal fan, and the guiding section is coaxially arranged with the impeller in the centrifugal fan.

3. The inlet collector according to claim 1, wherein an included angle between an arc midpoint line of the tragus-shaped section and a horizontal plane is a, and a value range of α is 140°-160°.

4. The inlet collector according to claim 1, wherein an arc angle of the tragus-shaped section is β, and a value range of β is 50°-80°.

5. A centrifugal fan, comprising: a fan volute, an inlet collector and an impeller;

wherein the impeller is fixed in the fan volute, and a side of the fan volute is disposed with a fan volute inlet, and the inlet collector is fixed at the fan volute inlet;

wherein the inlet collector comprises:

a connecting section, a guiding section and a tragus-shaped section;

wherein the guiding section is connected to an outer wall surface of the fan volute at a side adjacent to the fan volute inlet through the connecting section, the guiding section has a conical structure, and a middle of the guiding section is disposed with a through-hole;

wherein the tragus-shaped section has an arc-shaped surface, the tragus-shaped section is arranged on an inner side of the guiding section, and the tragus-shaped section is formed of lofting of a tragus profile along an axis of the impeller of the centrifugal fan;

wherein a width central point of tragus is taken as an origin, a x direction indicates a width distribution of tragus, and a y direction indicates a height distribution of tragus, and an equation of the tragus profile is:

$$y(x)=\begin{cases}-3.2x^2-2.464x-0.432, & -0.5\le x<-0.27\\ 0.24887-\frac{5}{12}(x+0.2037)-\sqrt{\frac{0.33636}{4.2}-\frac{58.31}{70.56}(x+0.2037)^2}, & -0.27\le x<0.07\\ -2.4x^2+1.368x-0.084, & 0.07\le x\le 0.5\end{cases};$$

wherein two end points of the tragus profile are located on an arc at a junction of the connecting section and the tragus-shaped section, a radius of the arc is R, and the y direction of the tragus profile is a radial inward extension direction of the tragus-shaped section.

6. The centrifugal fan according to claim 5, wherein the guiding section comprises an arc-shaped guiding segment;

wherein the arc-shaped guiding segment extends radially from an inner side of the connecting section into the fan volute, with the connecting section as a starting section, a cross-section of the arc-shaped guiding segment along a direction of extending depth being a ¼ circular surface, and a through-hole structure being as an end point of extending.

7. The centrifugal fan according to claim 5, wherein the guiding section comprises a vertical guiding segment;

wherein the vertical guiding segment is arranged extending along the axis of the impeller of the centrifugal fan, and the guiding section is coaxially arranged with the turbine in the centrifugal fan.

8. The centrifugal fan according to claim 5, wherein a distance from a maximum horizontal extension height of the tragus-shaped section to an axis center of the impeller is L, a value range of L/R is 0.65-0.8;

wherein an included angle between a midpoint line of an outer arc of the tragus-shaped section and a horizontal plane is α, and a value range of α is 140°-160°; and wherein an arc angle of the outer arc of the tragus-shaped section is β, and a value range of β is 50°-80°.

* * * * *